United States Patent [19]

Dickakian

[11] Patent Number: 4,551,225

[45] Date of Patent: Nov. 5, 1985

[54] HIGH ANISOTROPIC PITCH

[75] Inventor: Ghazi B. Dickakian, Kingwood, Tex.

[73] Assignee: E. I. Du Pont de Nemours and Company, Wilmington, Del.

[21] Appl. No.: 613,205

[22] Filed: May 23, 1984

[51] Int. Cl.[4] ..... C10C 3/00; C10C 3/06

[52] U.S. Cl. ..... 208/43; 208/22; 208/39; 208/44

[58] Field of Search ..... 208/22, 39, 44, 43

[56] References Cited

U.S. PATENT DOCUMENTS

| | | | |
|---|---|---|---|
| 3,974,264 | 8/1976 | McHenry | 208/39 |
| 3,976,729 | 8/1976 | Lewis et al. | 208/44 |
| 4,026,788 | 5/1977 | McHenry | 208/39 |
| 4,209,500 | 6/1980 | Chwastiak | 208/44 |

FOREIGN PATENT DOCUMENTS

| | | | |
|---|---|---|---|
| 0027739 | 4/1981 | European Pat. Off. | 208/44 |
| 101191 | 6/1983 | Japan | 208/44 |

*Primary Examiner*—D. E. Gantz
*Assistant Examiner*—Helane Myers

[57] ABSTRACT

An improved process for preparing an optically anisotropic pitch which comprises heating a pitch feed material at a temperature within the range of about 350° C. to 450° C. while passing an inert gas therethrough at a rate of at least 2.5 SCFH/lb of pitch feed material and agitating said pitch feed material at a stirrer rate of from about 500 to 600 rpm to obtain an essentially 100% mesophase pitch product suitable for carbon production.

3 Claims, 4 Drawing Figures

HIGH ANISOTROPIC PITCH

FIELD OF THE INVENTION

This invention pertains to the production of optically anisotropic pitch useful for carbon fiber production.

BACKGROUND OF THE INVENTION

Optically anisotropic pitches that can be spun into carbon fibers have been produced previously by heat soaking an aromatic feedstock containing polycondensed aromatic (3, 4, 5, 6 and 7) rings or by heating a petroleum pitch containing larger aromatic rings. During the heat soaking treatment polycondensed aromatic rings will polymerize and condense into aromatic ring agglomerates called liquid crystals (mesophase) which are 100% optically anistropic when polished sections are examined by polarized light microscopy.

Highly anisotropic pitches prepared from aromatic feed or from petroleum pitch contain unreacted oils, often in substantial amounts (25–35%). These oils must be almost completely removed to produce a pitch with the desired rheological properties such as softening point and viscosity; which are critical parameters for successful spinning, oxidation, carbonization treatments of the green fiber in the production of high tensile strength carbon fibers.

Removal of the unreacted oil from the heat soaked feed mixture can be achieved by many methods including vacuum stripping the unreacted oil at the end of the heat soaking step. This can be carried out by using the same heat soaking reactor. Such a method of oil removal has been used effectively to prepare aromatic pitches from steam cracker tar, catalytic cracking bottom and coal by-products. The preparation of these pitches are described in the following U.S. patents and patent applications: Pat. No. 4,086,156 (1978); Ser. No. 225,060 (1981); Ser. No. 346,624 (1982); Ser. No. 346,623 (1982); Ser. No. 399,751 (1982); Ser. No. 399,472 (1982); and Ser. No. 399,702 (1982).

Another method of removing the unreacted oils calls for conducting the heat soaking under reduced pressure, where these unreacted oil are removed continuously during the heat soaking step. This procedure for pitch preparation is described in U.S. Pat. No. 4,271,006 (1981).

A further method for removing the unreacted oil from the heat soaking mixture is by injection of an inert gas at the bottom of the heat soaked mixture to volatilize the light, distillable oils. The oil stripping efficiency and rate of oil removal will, of course, be dependent on the design of the reactor and the distillate recovery system, the rate that the inert gas is passed into the mixture, the design of the sparger, as well as the rate of agitation. A major objective of the present invention is to make maximum utilization of the stripping gas in such a process.

U.S. Pat. No. 3,974,264 (McHenry) describes such a process for producing a pitch with a high mesophase content using a substantially shorter time by passing an inert gas through the heated pitch (350°–450° C.) during the formation of the mesophase at a rate of at least 0.5 SCFH/lb of pitch and generally at a rate of 0.7 to 5.0 SCFH/lb of pitch.

A later U.S. Pat. No. 4,209,500 (Chwastiak) describes the production of an aromatic pitch with high optical anisotropy by heating a petroleum pitch feed at 380°–430° C. and passing nitrogen through the heat soaked mixture at a rate of at least 4.0 SCFH/lb of pitch and up to 10.0 SCFH/lb of pitch. This patent asserts that an improved process for aromatic pitch production with 100% optical anisotropy is achieved by increasing the rate of which the nitrogen gas is passed into the heat soaked mixture for efficient stripping of the unreacted distillable oils thereby increasing the rate of mesophase formation.

As we indicated above, the degree of oil stripping from a heat soaked mixture depends on the rate of inert gas injection into the bottom of the reactor. It now has been found that the stripping of oils is also dependent on a number of other operating conditions.

SUMMARY OF THE INVENTION

In accordance with the present invention it has been found that the rate of mechanical agitation is as important as the nitrogen gas feed rate for increasing the rate of optical anisotropic development in the pitch during heat soaking. Increased inert gas injection into the molten pitch can soon reach a maximum in the absence of efficient dispersion of the gas into the molten pitch. It also has been found that efficient agitation can produce pitches with 100% mesophase content with a low nitrogen rate injection i.e., 2.5 SCFH/lb of pitch, which is below what U.S. Pat. No. 4,209,500 states to be too low and ineffective.

DETAILED DESCRIPTION OF THE INVENTION

The effect of agitation on optical anisotropic development was demonstrated by heat soaking a commercial petroleum pitch (Ashland 240) with nitrogen injection at the bottom of an electrically heated reactor equipped with an agitator of which the rate of agitation can vary from about 200–600 rpm, preferably from about 300 to 550 rpm. The nitrogen gas was injected at the bottom of the reactor using a gas sparger designed to ensure efficient gas distribution into the molten pitch.

Figure 1:
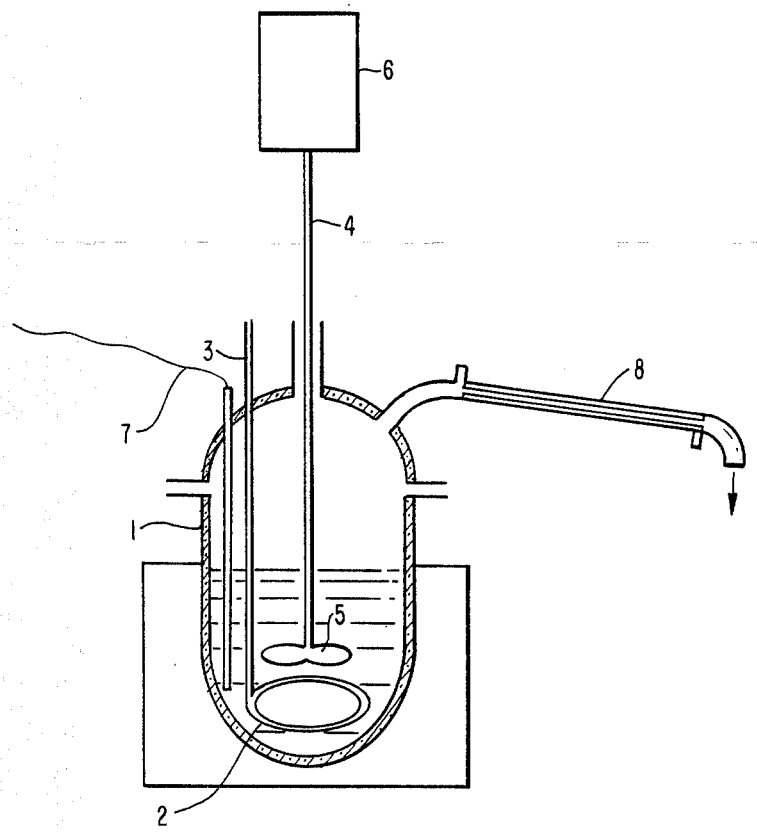
FIG. 1 is a schematic diagram of a reactor for heat soaking and for removing unreacted oils from pitches from aromatic feed or petroleum pitch.
Figure 2:
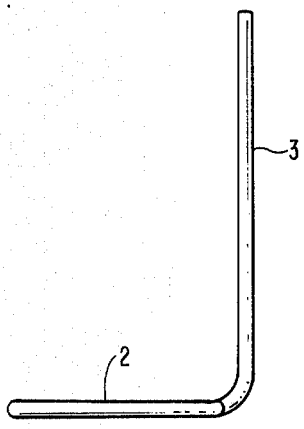
FIG. 2 is a side view of the gas sparger provided with a nitrogen gas feed line and a sparger ring.
Figure 3:
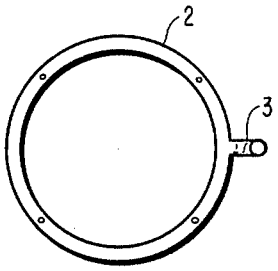
FIG. 3 is a bottom view of the gas sparger shown in FIG. 2 and the gas exit holes positioned on the bottom side of the ring.

The design of the type of sparger for the present invention is illustrated in FIGS. 1 through 3 where an electrically heated glass reactor 1 is provided with a gas sparger ring 2 connected to a nitrogen feed line 3. Positioned above gas sparger 2 is an agitator 4 provided with blades 5 and driven by stirring motor 6. Reactor is also equipped with a thermocouple 7 for accurate measurement of the heat soaking temperature and a condenser 8 for recovering the unreacted hydrocarbon oils.

The agitator blades 5 are placed immediately above sparger ring 2 to distribute efficiently the nitrogen gas from the sparger into the molten pitch to effect stripping of the unreacted oil while controlling agitation by varying the rpm of agitator blades 5.

The present invention will be more fully understood by reference to the following illustrative embodiments.

EXAMPLES 1, 2, 3, 4 and 5

675 grams of Ashland Petroleum Pitch 240 were introduced into a one liter reactor. The Ashland pitch had the following characteristics:

| | |
|---|---|
| Softening point, °C. | 122.4 |
| Density | 1.230 |
| Coking Valve (%) | 52.0 |
| Flash Point, °C. | 290 |
| Sulfur Content (wt %) | 1.40 |
| Toluene Insolubles (%) | 7.4 |
| Quinoline Insolubles (%) | 0.14 |

As shown in FIG. 1 the reactor was equipped with a gas sparger ring 2 which is placed at the bottom of the reactor 1, an agitator 4 with blades 5 placed immediately above the sparger, a thermocouple 7 for controlling the pitch temperature, and a condensor 8 to recover hydrocarbon material leaving the reactor 1. The nitrogen gas feed line 3 was made ¼ inch O.D. Type 304 stainless steel tubing that was bent to form a gas sparger ring 2 having a diameter of 2.5 inches and four 0.015 orifices on the botton side of the ring at approximately 90 degree spacings. The gas feed or supply line had a 3 length of about 8 to 10 inches.

The Asland pitch in the reactor was heat soaked at 400° C. for 12 hours at atmospheric pressure with the agitation rate of 330 rpm. The nitrogen rate injected at the bottom of the reactor was varied 1.5, 3.0, 3.5, 4.0, and 5.0 SCFH/lb of pitch, respectively, for each run. The pressure of the nitrogen used for stripping was 80.0 psig. When heat soaking was completed, the molten pitch was cooled under nitrogen atmosphere to room temperature. The pitch produced was characterized by the following methods:

(a) Regular Toluene Insolubles (RTI)—10 grams of sample and 500 cc of toluene reflexed for one hour and then filtered through medium glass filter.

(b) Regular Pyridine Insolubles (RPI)—2 grams sample and 100 cc pyridine refluxed for one hour and filtered (medium filter).

(c) Quinoline Insolubles (QI)—One gram sample and 25 cc quinoline shaked for 4.0 hours at 75° C. and filtered (medium filter).

(d) Pyridine Insolubles (Soxhlet method)—2.5 grams (80–100 mesh) of the pitch were placed in a glass soxhlet and extracted with refluxing pyridine for 24 hours.

(e) Optical Anisotropy (OA %)—polished sections of the pitch were examined by cross polarized light microscopy (with ×10).

The results obtained using nitrogen injection rates 1.5, 3.0, 4.0 and 5.0 SCFH/lb of pitch are given below:

TABLE A

| | HEAT SOAKING CONDITIONS | | | | | PITCH ANALYSES | | |
|---|---|---|---|---|---|---|---|---|
| EXAMPLE | FEED CHARGE (gms) | NITROGEN RATE (SCFH/lb) | AGITATION (RPM) | TEMP. (°C.) | TIME (HRS) | REGULAR RPI (%) | SOXHLET RPI (%) | OA (%) |
| 1 | 675 | 1.5 | 330 | 400 | 12 | 19.0 | 36.6 | 25 |
| 2 | 675 | 3.0 | 330 | 400 | 12 | 31.8 | 44.6 | 95 |
| 3 | 675 | 3.5 | 330 | 400 | 12 | — | — | 95 |
| 4 | 675 | 4.0 | 330 | 400 | 12 | 44.6 | 50.3 | 100 |
| 5 | 675 | 5.0 | 330 | 400 | 12 | 54.8 | 59.3 | 100 |

EXAMPLES 6, 7 and 8

Pitch production was repeated using the method described in Examples 1 through 5 with one execption: A higher rate of agitation (530 RPM). Pitch production was repeated using 2.0, 2.5 and 3.0 SCFH/lb of nitrogen. Pitch analysis is as follows:

TABLE B

| | HEATING SOAKING CONDITIONS | | | | | PITCH ANALYSES | | | |
|---|---|---|---|---|---|---|---|---|---|
| EXAMPLE | FEED CHARGE (gms) | NITROGEN RATE (SCFH/lb) | AGITATION (RPM) | TEMP. (°C.) | TIME (HRS) | REGULAR RPI (%) | SOXHLET RPI (%) | QI (%) | OA (%) |
| 6 | 675 | 2.0 | 530 | 400 | 12 | 56.9 | 50.4 | 43.9 | 90 |
| 7 | 675 | 2.5 | 530 | 400 | 12 | — | 44.5 | 41.5 | 100 |
| 8 | 675 | 3.0 | 530 | 400 | 12 | 62.3 | 55.9 | 50.2 | 100 |

Figure 4:
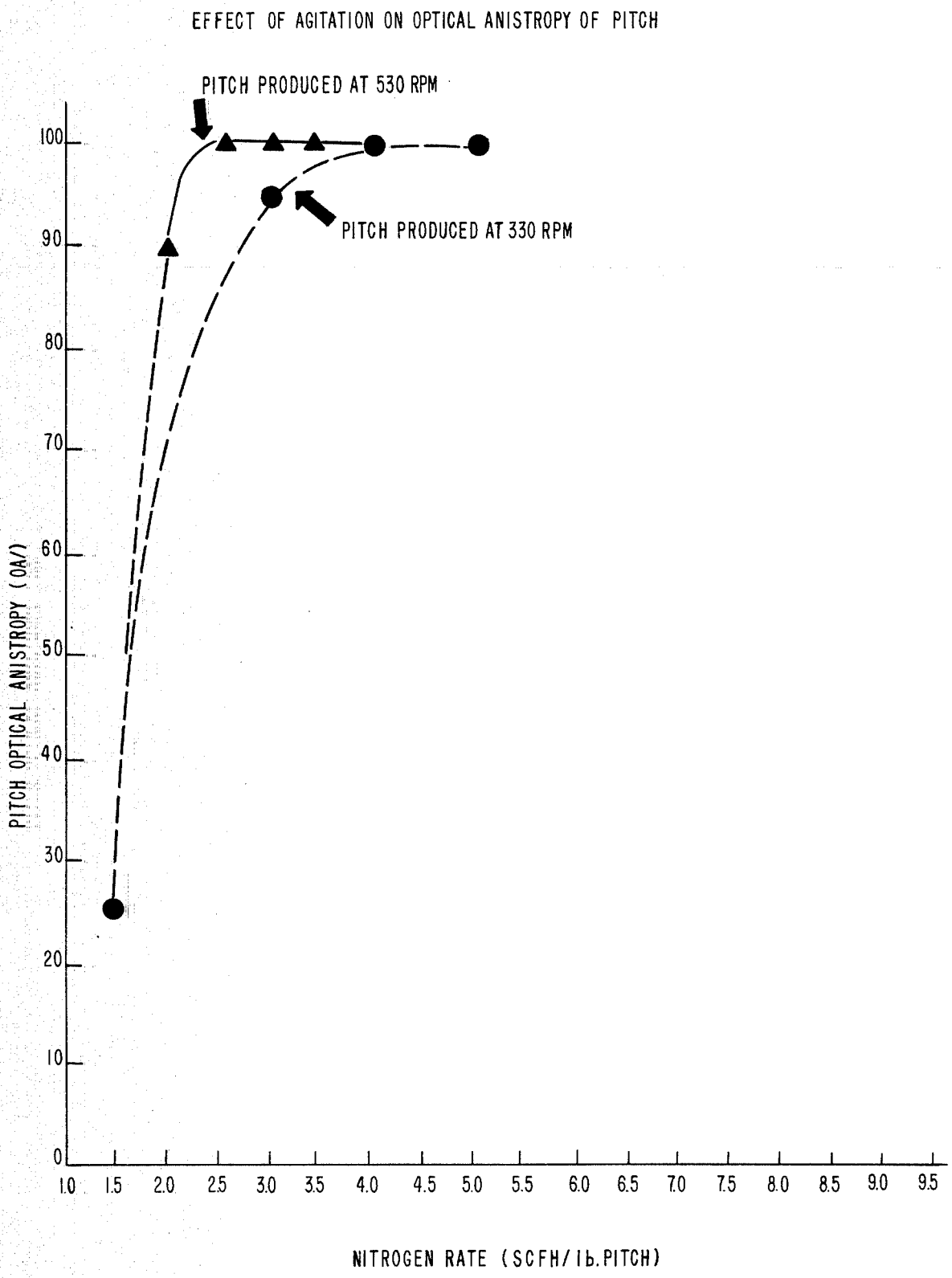
FIG. 4 is a graph illustrating optical anisotropy formation based on the rate of agitation.

The comparison of the development of optical anisotropy in the pitch using the low and high agitation rates is illustrated in FIG. 4. The data show that with high agitation and a nitrogen gas rate as low as 2.5 SCHF/lb pitch gave 100% optical anisotropy. As noted above, the present discovery concerns the criticality of the agitation rate in conjunction with the nitrogen gas rate in obtaining an essentially 100% optical anisotropic pitch feed material suitable for carbon fiber production.

Various changes and modifications can be made in the method of this invention without departing from the scope and spirit thereof. Although embodiments of the inventions have been illustrated above, there was no intention to limit the invention thereto.

What is claimed is:

1. In a process for preparing an essentially 100% mesophase pitch suitable for spinning into carbon fibers wherein a pitch feed material is heat-soaked at a temperature of from about 350° C. to 450° C.; the improvement which comprises passing an inert gas through said pitch feed at a rate of from 2.5 to 3.5 SCFH/lb of pitch feed during said heat-soaking treatment and while said pitch feed is agitated at a stirrer rate ranging from about 300 to 500 rpm to obtain mechanical agitation sufficient, in combination with the inert gas rate, to produce an essentially 100% mesophase pitch product at an inert gas rate of from 2.5 to 3.5 SCFH.

2. The process of claim 1 wherein said heat-soaking temperature ranges from about 380° C. to 430° C.

3. The process of claim 1 wherein said inert gas is nitrogen or steam.

* * * * *